US011668123B2

(12) United States Patent
Park

(10) Patent No.: US 11,668,123 B2
(45) Date of Patent: Jun. 6, 2023

(54) WASHING MACHINE

(71) Applicant: SAMSUNG ELECTRONICS CO., LTD., Suwon-si (KR)

(72) Inventor: Naeyoung Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 275 days.

(21) Appl. No.: 17/190,652

(22) Filed: Mar. 3, 2021

(65) Prior Publication Data

US 2021/0277691 A1 Sep. 9, 2021

(30) Foreign Application Priority Data

Mar. 3, 2020 (KR) ..... 10-2020-0026817

(51) Int. Cl.
*D06F 37/10* (2006.01)
*E05C 17/00* (2006.01)
*D06F 39/14* (2006.01)

(52) U.S. Cl.
CPC ..... *E05C 17/025* (2013.01); *D06F 39/14* (2013.01); *E05Y 2900/312* (2013.01)

(58) Field of Classification Search
CPC ... D06F 39/14; E05C 17/025; E05Y 2900/312
USPC ..... 68/196
See application file for complete search history.

(56) References Cited

U.S. PATENT DOCUMENTS

2018/0363228 A1* 12/2018 Gim ..... D06F 39/14

FOREIGN PATENT DOCUMENTS

| | | |
|---|---|---|
| JP | 2011-234785 | 11/2011 |
| JP | 2017-38828 | 2/2017 |
| KR | 10-2009-0028039 | 3/2009 |
| KR | 10-1708679 | 2/2017 |

* cited by examiner

*Primary Examiner* — Tinsae B Ayalew
(74) *Attorney, Agent, or Firm* — Staas & Halsey LLP

(57) ABSTRACT

Disclosed is a washing machine including a main body, a drum provided inside the main body and having an accommodating space to accommodate laundry, a door rotatably provided in a first direction of opening the accommodating space or a second direction of closing the accommodating space, and a hinge bracket coupled to the main body to connect the door and the main body, wherein the door includes a pusher configured to maintain the accommodating space in an open state by assisting the rotation of the door in the first direction, the pusher pressing the hinge bracket.

20 Claims, 10 Drawing Sheets

WASHING MACHINE

CROSS-REFERENCE TO RELATED APPLICATION(S)

This application is based on and claims priority under 35 U.S.C. § 119 to Korean Patent Application No. 10-2020-0026817, filed on Mar. 3, 2020, in the Korean Intellectual Property Office, the disclosure of which is incorporated by reference herein in its entirety.

BACKGROUND

1. Field

The disclosure relates to a washing machine with an improved structure to maintain a door in an open state.

2. Description of the Related Art

In general, a washing machine is a device for washing laundry through mutual friction by stirring together the laundry, washing water, and detergent contained in a washing tub using a driving force of a motor. As a type of washing machine, there are a drum washing machine in which laundry is washed by falling down after being lifted upward along an inner circumferential surface of a rotary tub as the rotary tub, which is disposed substantially horizontally, rotates in the forward and reverse directions with respect to a horizontal axis, and a vertical axis washing machine in which laundry is washed using a water current generated by a pulsator disposed inside a rotary tub as the rotary tub, which is disposed substantially vertically, rotates in the forward and reverse directions with respect to a vertical axis.

A drum washing machine includes a cabinet forming an outer appearance, a cylindrical tub installed inside the cabinet and containing washing water, a drum rotatably installed inside the tub to wash laundry, a driving motor disposed at the rear of the tub to rotate the drum, and a door installed on a front side of the cabinet. An opening communicating with the drum is provided on at least a portion of the cabinet, and the door is provided to open and close the opening.

After a washing process is completed, the door may be closed by the weight of the door or external influences even when a user does not forcefully close the door.

In this case, it is difficult to release moisture in the washing machine, which may cause mold or odor. In addition, if an infant enters the washing machine, it may lead to personal accidents due to insufficient internal oxygen.

SUMMARY

It is an aspect of the disclosure to provide a washing machine including a pusher capable of maintaining a door in an open state.

It is another aspect of the disclosure to provide a washing machine having an improved structure so that a door opening angle for maintaining the amount of dissolved oxygen inside the washing machine over a certain level may be set.

It is another aspect of the disclosure to provide a washing machine having an improved structure so that there is no limit to the design implementation of a washing machine body.

Additional aspects of the disclosure will be set forth in part in the description which follows and, in part, will be obvious from the description, or may be learned by practice of the disclosure.

In accordance with an aspect of the disclosure, a washing machine includes a main body, a drum provided inside the main body and having an accommodating space to accommodate laundry, a door rotatably provided in a first direction of opening the accommodating space or a second direction of closing the accommodating space, and a hinge bracket coupled to the main body to connect the door and the main body, wherein the door includes a pusher configured to maintain the accommodating space in an open state by assisting the rotation of the door in the first direction, the pusher pressing the hinge bracket.

The pusher may include a protrusion protruding to the rear of the door to press a front surface of the hinge bracket.

The door may further include a rear frame forming a portion of a rear surface of the door, and a protrusion passing hole through which the protrusion passes may be formed on one side of the rear frame.

The protrusion may include a pressing part protruding to the rear of the rear frame, and a separation preventing part extending radially outward so that the protrusion is not separated from the rear frame.

The pusher may further include a spring provided to elastically support the protrusion, and the door may further include a support plate disposed in the front of the rear frame to support one end of the spring.

The hinge bracket may include a body coupled to a front panel of the main body, a plurality of legs extending from the body, and a shaft extending from each of the plurality of legs in a rotation axis direction of the door.

The pusher may be provided to press a front surface of the body between the plurality of legs.

The door may further include a rear frame provided to form a portion of a rear surface of the door, and a support plate provided in the front of the rear frame, and the shaft may be accommodated between the rear frame and the support plate so that the door rotates with respect to the hinge bracket.

The pusher may be fixed between the rear frame and the support plate, and one end thereof may protrude to the rear of the door.

The rear frame and the support plate may form a plurality of leg accommodating grooves to accommodate the plurality of legs.

The pusher may be provided between the plurality of leg accommodating grooves.

The pusher may move elastically, and a stroke length of the pusher may be formed between 2 mm or more and 10 mm or less.

An opening angle of the door with respect to the main body according to the stroke length of the pusher may be formed at 5 degrees or more.

The hinge bracket may be coupled to the front of the main body to protrude from a front surface of the main body.

In accordance with another aspect of the disclosure, a washing machine includes a main body having an opening, a drum provided inside the main body, a door rotatably provided to open and close the opening, and a hinge bracket coupled to the main body, wherein the door includes a rear frame forming a portion of a rear surface of the door and having one side to which a shaft of the hinge bracket is connected, and a pusher configured to elastically press the hinge bracket by protruding from the rear frame so that the opening is maintained in an open state.

The pusher may include a protrusion provided to press a front surface of the hinge bracket, and a spring provided to elastically support the protrusion.

The door may further include a support plate mounted in the front of one side of the rear frame to support one end of the spring.

The protrusion may include a separation preventing part extending radially outward so that the protrusion is not separated to the rear of the rear frame, and the pusher may be fixed and mounted inside the rear frame and the support plate.

In accordance with another aspect of the disclosure, a washing machine includes a main body having an opening, a door provided to open and close the opening, and a hinge bracket coupled to the main body so that the door is rotatable with respect to the main body and including a shaft accommodated in one side of the door, wherein the door includes a pusher protruding rearward from one side of the door to elastically press a front surface of the hinge bracket.

The door may further include a rear frame forming a portion of a rear surface of the door, and a support plate forming a shaft accommodating groove together with the rear frame to accommodate the shaft, and the pusher may be mounted between the rear frame and the support plate.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Configurations shown in the embodiments and the drawings described in the present specification are only the preferred embodiments of the present disclosure, and thus it is to be understood that various modified examples, which may replace the embodiments and the drawings described in the present specification, are possible when filing the present application.

Like reference numbers or signs in the various figures of the application represent parts or components that perform substantially the same functions.

The terms used herein are for the purpose of describing the embodiments and are not intended to restrict and/or to limit the disclosure. For example, the singular expressions herein may include plural expressions, unless the context clearly dictates otherwise.

The terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that although the terms first, second, etc. may be used herein to describe various components, these components should not be limited by these terms, and the terms are only used to distinguish one component from another.

For example, without departing from the scope of the disclosure, the first component may be referred to as a second component, and similarly, the second component may also be referred to as a first component. The term "and/or" includes any combination of a plurality of related items or any one of a plurality of related items.

The terms "front end," "rear end," "upper portion," "lower portion," "upper end" and "lower end" used in the following description are defined with reference to the drawings, and the shape and position of each component are not limited by these terms.

Hereinafter, embodiments of the disclosure will be described in detail with reference to the accompanying drawings.

Figure 1:
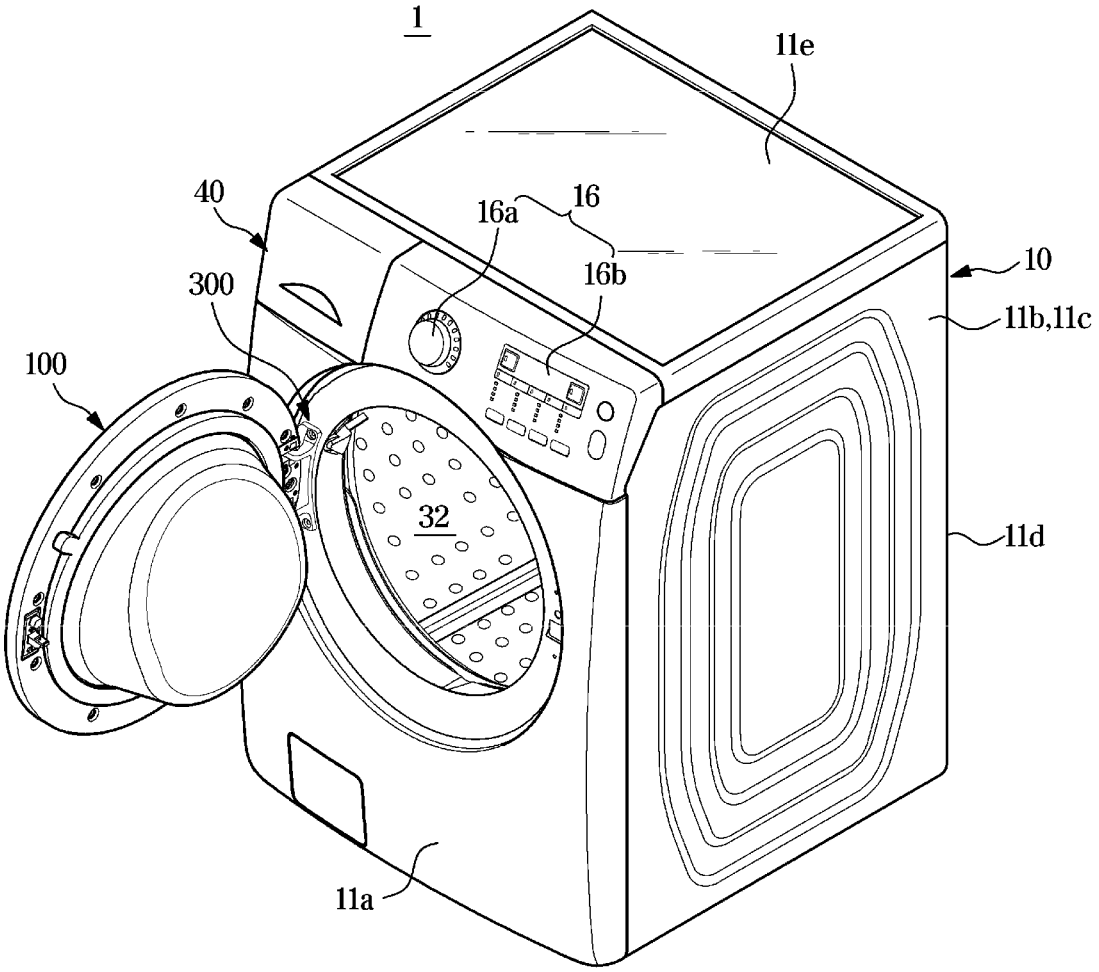
FIG. 1 is a perspective view of a washing machine according to an embodiment of the disclosure.
Figure 2:
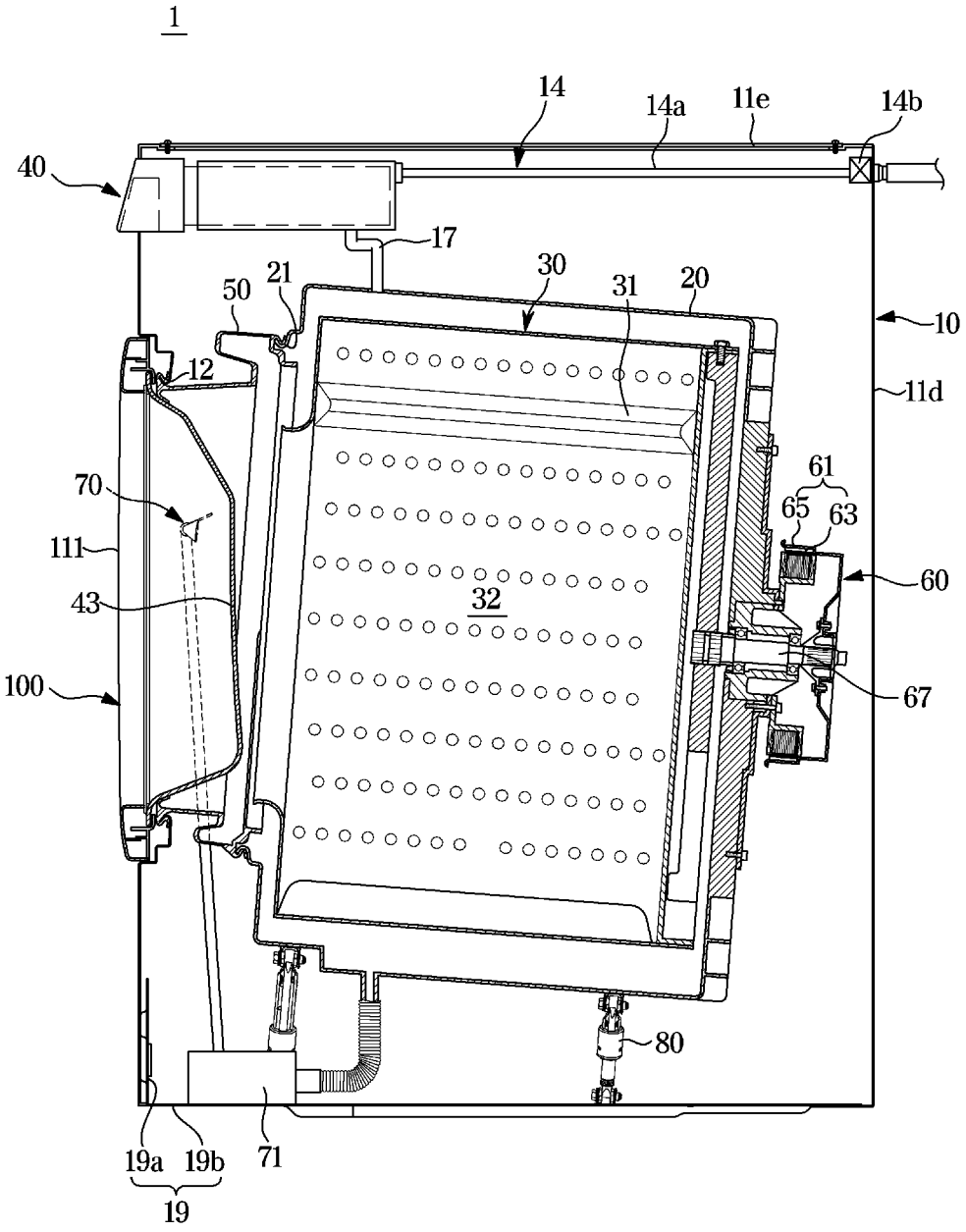
FIG. 2 is a cross-sectional view of the washing machine according to an embodiment of the disclosure.

FIG. 1 is a perspective view of a washing machine according to an embodiment of the disclosure, and FIG. 2 is a cross-sectional view of the washing machine according to an embodiment of the disclosure.

Referring to FIGS. 1 and 2, a washing machine 1 includes a main body 10 forming an outer appearance and accommodating various components therein, a tub 20 provided inside the main body 10 to store mixed water in which washing water and a detergent are mixed, a drum 30 provided inside the tub 20 to accommodate and rotate laundry, and a driving device 60 to rotate the drum 30.

The main body 10 may be formed in a substantially hexahedral shape. The main body 10 may be formed in a box shape with an open front. The main body 10 may include a rear plate lid and opposite side plates 11*b* and 11*c* disposed on one side and the other side in the front of the rear plate 11*d*. An embodiment of the disclosure illustrates that the main body 10 has a rear plate lid and the opposite side plates 11*b* and 11*c* integrally formed, but the disclosure is not limited thereto, and the rear plate 11*d* and the opposite side plates 11*b* and 11*c* may be formed in separate configurations, respectively.

The main body 10 may include a front panel 11*a* provided on an open front, a base 19 provided on a bottom, and a top cover 11*e* provided on an upper side.

A control panel 16 including an input 16*a* receiving an operation command from a user and a display 16*b* displaying operation information of the washing machine 1 may be provided on a front surface of the main body 10.

The base 19 may include a lower frame 19*b* covering a lower portion of the main body 10 and a lower reinforcing frame 19*a* extending from the lower frame 19*b*.

A water supply valve 14*b* and a water supply pipe 14*a* for controlling water supply, and a detergent supply device 40 for supplying a detergent into the tub 20 during a water supply process may be installed above the tub 20.

The detergent supply device 40 may be connected to the tub 20 through a water supply pipe 17. Washing water supplied through the water supply pipe 14*a* is mixed with the detergent via the detergent supply device 40, and the mixed water in which the washing water and the detergent are mixed may be supplied into the tub 20. Unlike the above, the water supply pipe 14*a* may be directly connected to the inside of the tub 20 through a separate control valve (not shown). In this case, a liquid detergent may be supplied into the tub 20 through the detergent supply pipe 17 after passing through the detergent supply device 40.

The driving device 60 may be provided at the rear of the drum 30. The driving device 60 for rotating the drum 30 may be configured to transmit a driving force generated by a motor 61 to a rotating shaft to rotate the drum 30.

The motor 61 may include a fixed stator 63 and a rotor 65 rotating by electromagnetically interacting with the stator 63. Through this configuration, electrical energy may be converted into kinetic energy, that is, into a mechanical rotational force.

The tub 20 stores mixed water in which washing water and the detergent are mixed, and may be formed in a substantially cylindrical shape. The tub 20 may be fixed inside the main body 10. An opening 12 on the front panel 11*a* and the tub 20 of the main body 10 may be connected by a diaphragm 50.

One side of the diaphragm 50 may be provided with a spray nozzle 70 connected to a circulation hose to spray the mixed water which is circulated, into the drum 30. The spray nozzle 70 is configured to spray the mixed water evenly over the entire laundry accommodated in the drum 30. The circulation hose may be connected to a circulation pump 71 configured to pump the mixed water stored in a lower portion of the tub 20.

The drum 30 may perform washing by lifting and falling laundry while rotating inside the tub 20. The drum 30 may be provided inside the main body 10. The drum 30 may include an accommodating space 32 to accommodate laundry. A plurality of lifters 31 may be provided on an inner surface of the drum 30.

A drainage device (not shown) including a drain pipe (not shown), a drain valve (not shown), and the like for draining water inside the tub 20 may be installed below the tub 20.

The tub 20 is provided to be elastically supported on the main body 10 by an upper spring (not shown) and a lower damper 80. That is, when the vibration generated when the drum 30 rotates is transmitted to the tub 20 and the main body 10, the spring and the damper 80 are provided to attenuate the vibration that is transmitted to the main body 10 by absorbing vibration energy between the tub 20 and the main body 10.

The opening 12 may be formed on the front panel 11*a* of the main body 10 to allow laundry to be put in or out of the drum 30, Opening are formed on the tub 20 and the drum 30, respectively, to allow laundry to be put in or out of the main body 10, and the openings of the tub 20 and the drum 30 may be provided to correspond to the opening 12 of the front panel 11*a*.

The opening 12 provided on the front panel 11*a* may be opened and closed by the door 100. Also, the accommodating space 32 of the drum 30 may be opened and closed by the door 100. The door 100 may be provided to be rotatable in a first direction A of opening the accommodating space 32 and the opening 12 or in a second direction B of closing the accommodating space 32 and the opening 12. In the case of the disclosure, the first direction A may be a clockwise direction, and the second direction B may be a counterclockwise direction. However, the disclosure is not limited thereto, and in the case of the washing machine 1 in which the rotation direction of the door 100 may be changed, the first direction A may become the counterclockwise direction and the second direction may become the clockwise direction, depending on a mounting position of a hinge bracket 300.

Specifically, the door 100 may be rotatably mounted on the front panel 11*a* of the main body 10 by the hinge bracket 300. The hinge bracket 300 may be coupled to the main body 10 to connect the door 100 and the main body 10. The hinge bracket 300 may also be mounted in the front of the front panel 11*a* of the main body 10. Through this configuration, the hinge bracket 300 may be coupled to protrude from the front surface of the main body 10 and pressed by a pusher 200, which will be described later. A specific relationship between the pusher 200 and the hinge bracket 300 will be described later.

Figure 3:
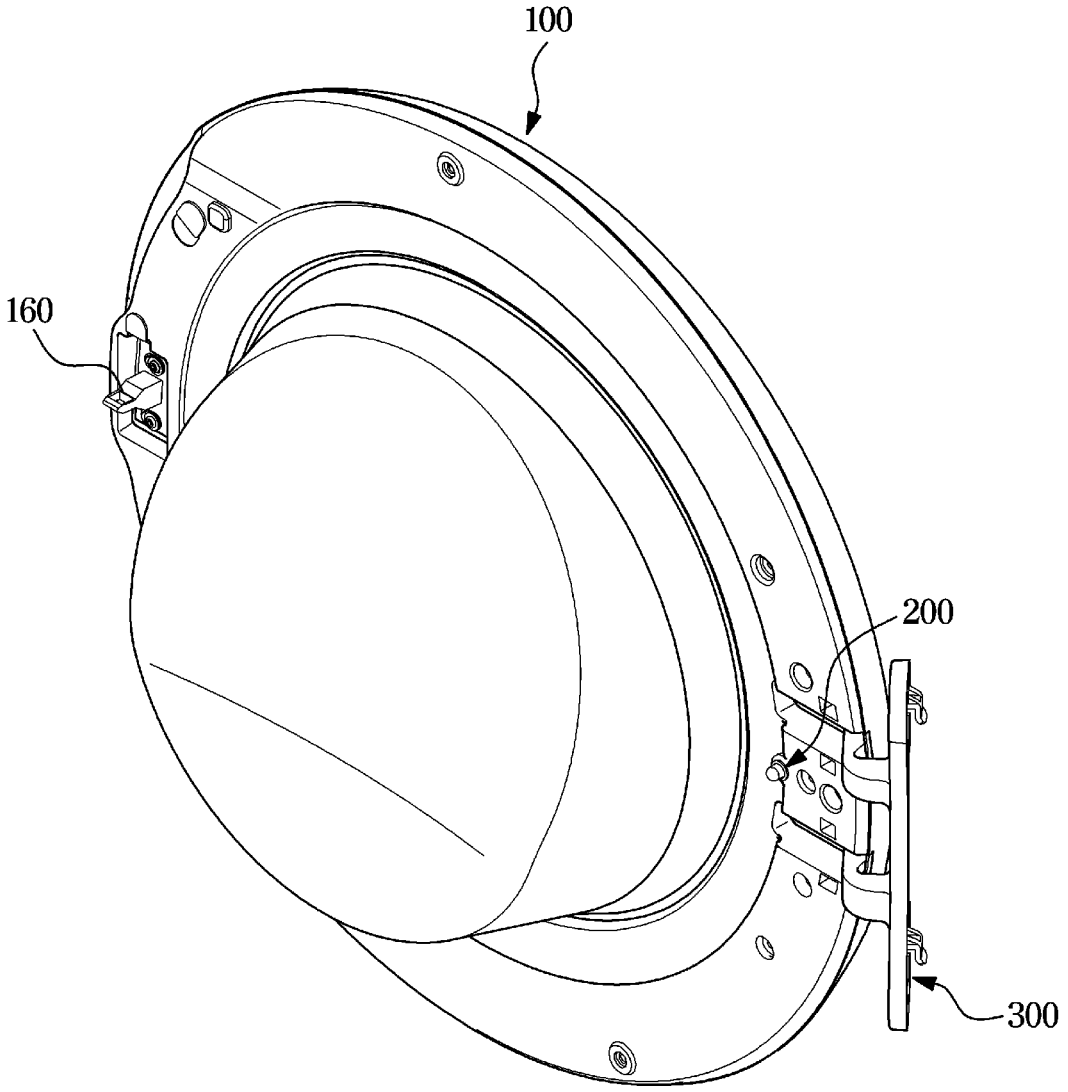
FIG. 3 is a rear perspective view of a door and a hinge bracket of the washing machine according to an embodiment of the disclosure.
Figure 4:
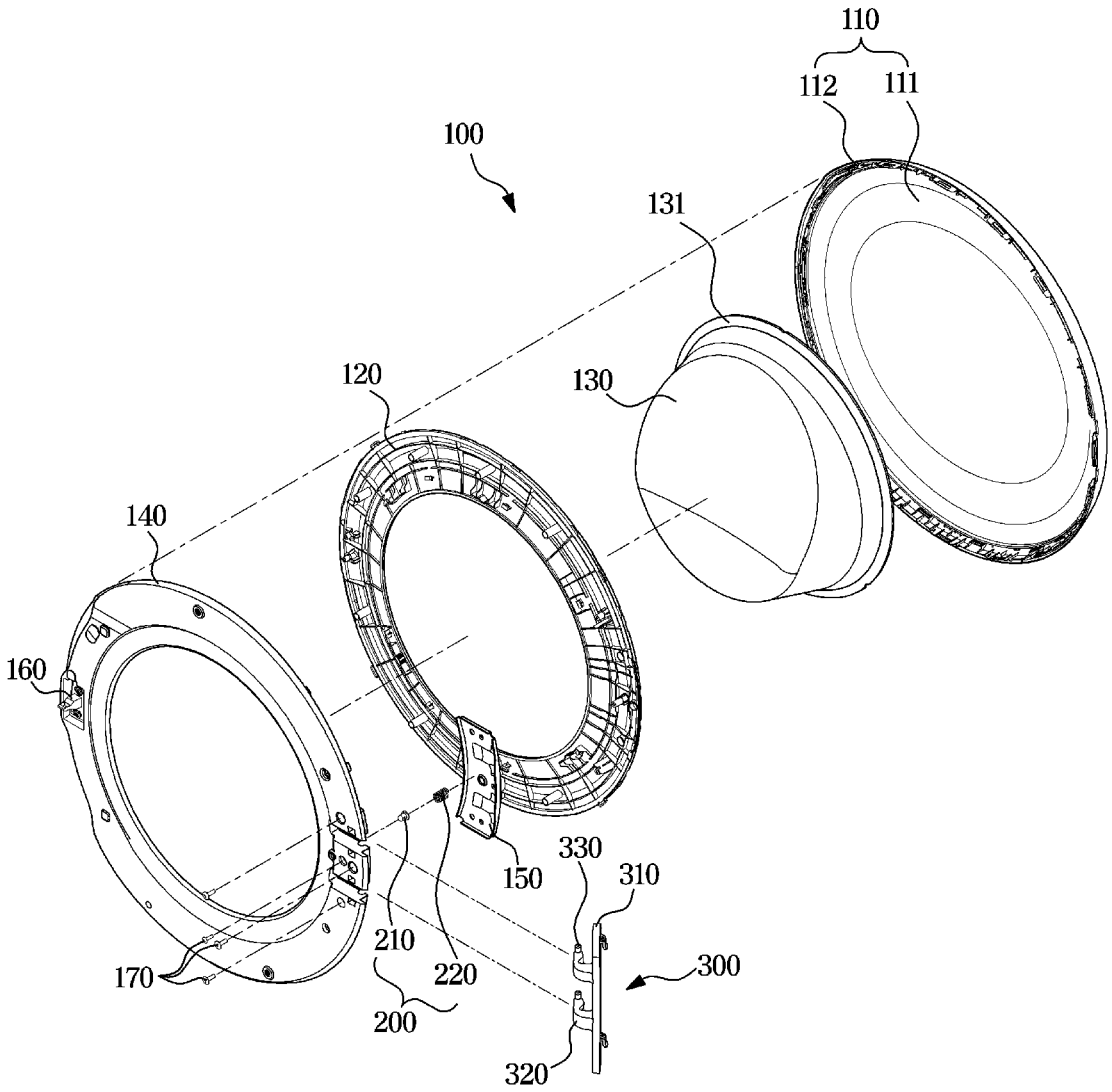
FIG. 4 is an exploded perspective view of the door of the washing machine according to an embodiment of the disclosure.

FIG. 3 is a rear perspective view of a door and a hinge bracket of the washing machine according to an embodiment of the disclosure, and FIG. 4 is an exploded perspective view of the door of the washing machine according to an embodiment of the disclosure.

Referring to FIGS. 3 and 4, the door 100 may include a plurality of frames 110, 120 and 140 and a door glass 130.

The door 100 may include the front frame 110, the inner frame 120, the door glass 130, and the rear frame 140.

The front frame 110 may form a front appearance of the door 100. The front frame 110 may include a door cover 111 and a side frame 112. The door cover 111 may form a front surface of the door 100. The side frame 112 may be coupled to the door cover 111 to form a side surface of the door 100.

The side frame 112 may be formed in a substantially annular ring shape. The side frame 112 may couple the door cover 111 and the rear frame 140. Specifically, the side frame 112 may be coupled to the rear frame 140 by grooves and protrusions.

The inner frame 120 may be positioned in the rear of the front frame 110 and in the front of the rear frame 140. That is, the inner frame 120 may be disposed between the front frame 110 and the rear frame 140.

The inner frame 120 is formed in an annular ring shape to have an opening, and may fix an edge portion 131 of the door glass 130 together with the rear frame 140. A fastening member 170 is inserted from the rear of the inner frame 120 so that the rear frame 140, a support plate 150, and the inner frame 120 may be integrally coupled.

The door glass 130 may include the edge portion 131 disposed between the inner frame 120 and the rear frame 140. Through this configuration, the door glass 130 may be fixed between the inner frame 120 and the rear frame 140.

The rear frame 140 may be provided to form a portion of a rear surface of the door 100. The hinge bracket 300 may be coupled to one side of the rear frame 140. A lever 160 provided to maintain a closed state of the door 100 when the door 100 rotates to a position to close the opening 12 of the main body 10 may be coupled to the other side of the rear frame 140.

The rear frame 140 has an opening and may be formed in a substantially annular ring shape. The rear frame 140 may be provided to support and fix the edge portion 131 of the door glass 130 together with the inner frame 120. A protrusion passing hole 143 through which a protrusion 210 of the pusher 200, which will be described later, passes may be formed on one side of the rear frame 140.

A support plate 150 may be disposed between the rear frame 140 and the inner frame 120. The support plate 150 may be provided on one side of the rear frame 140, which is a side to which the hinge bracket 300 is coupled.

Specifically, the support plate 150 may be provided to support one end of a spring 220 of the pusher 200. The fastening member 170 may penetrate from the rear of the support plate 150.

A specific coupling relationship between the rear frame 140, the pusher 200, the support plate 150, and the hinge bracket 300 will be described later.

Figure 5:
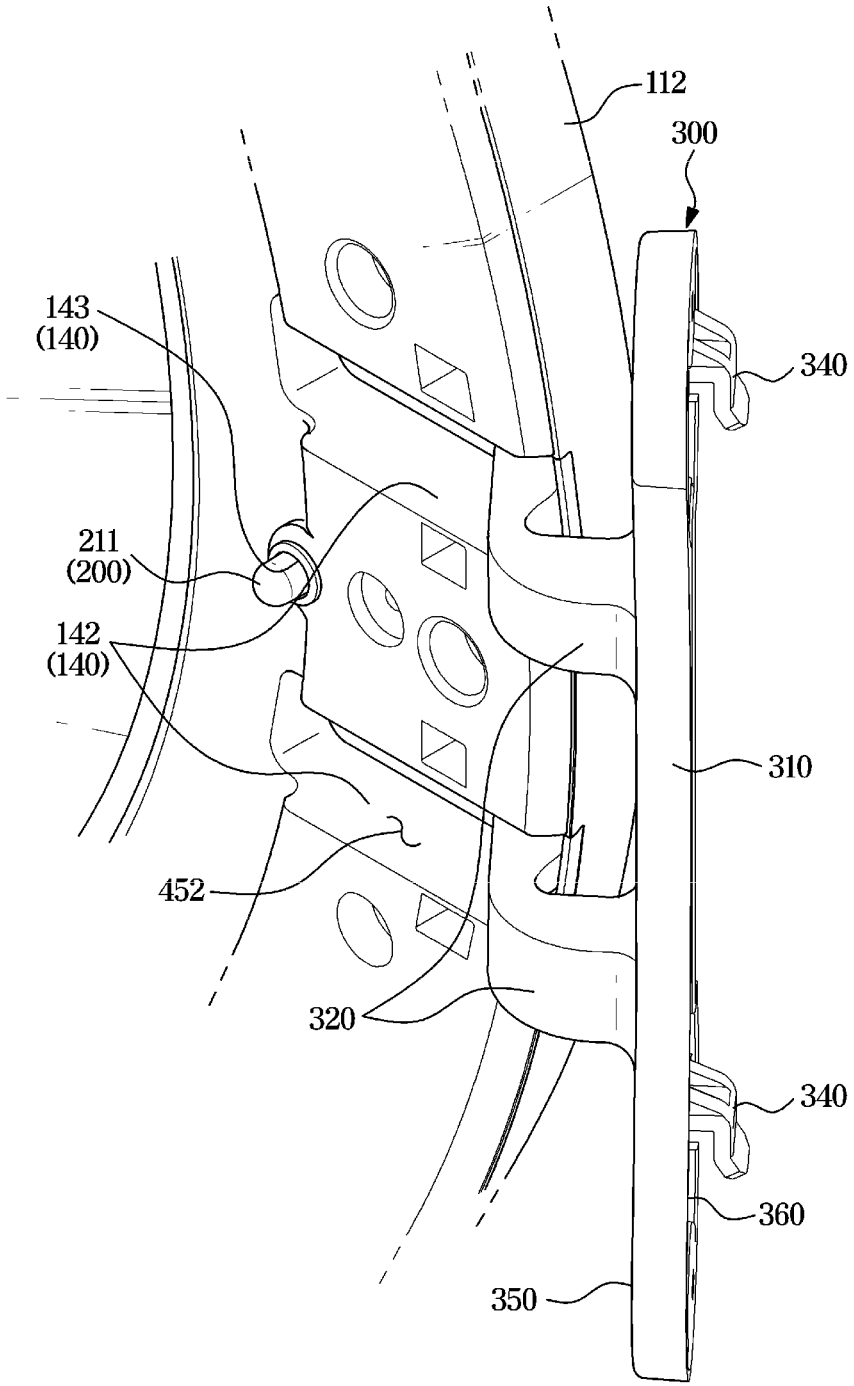
FIG. 5 is an enlarged rear perspective view of a portion of the door and the hinge bracket of the washing machine according to an embodiment of the disclosure.
Figure 6:
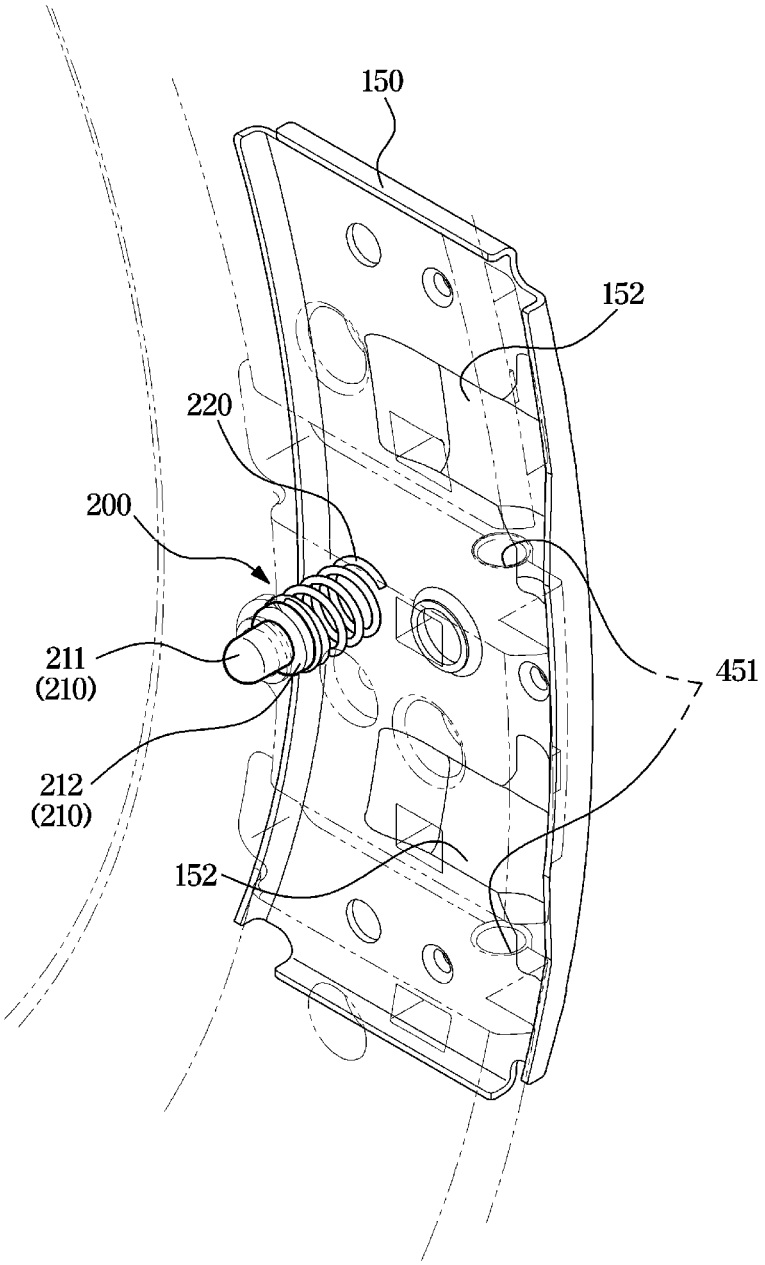
FIG. 6 is a rear perspective view of a pusher and a rear plate of the washing machine according to an embodiment of the disclosure.
Figure 7:
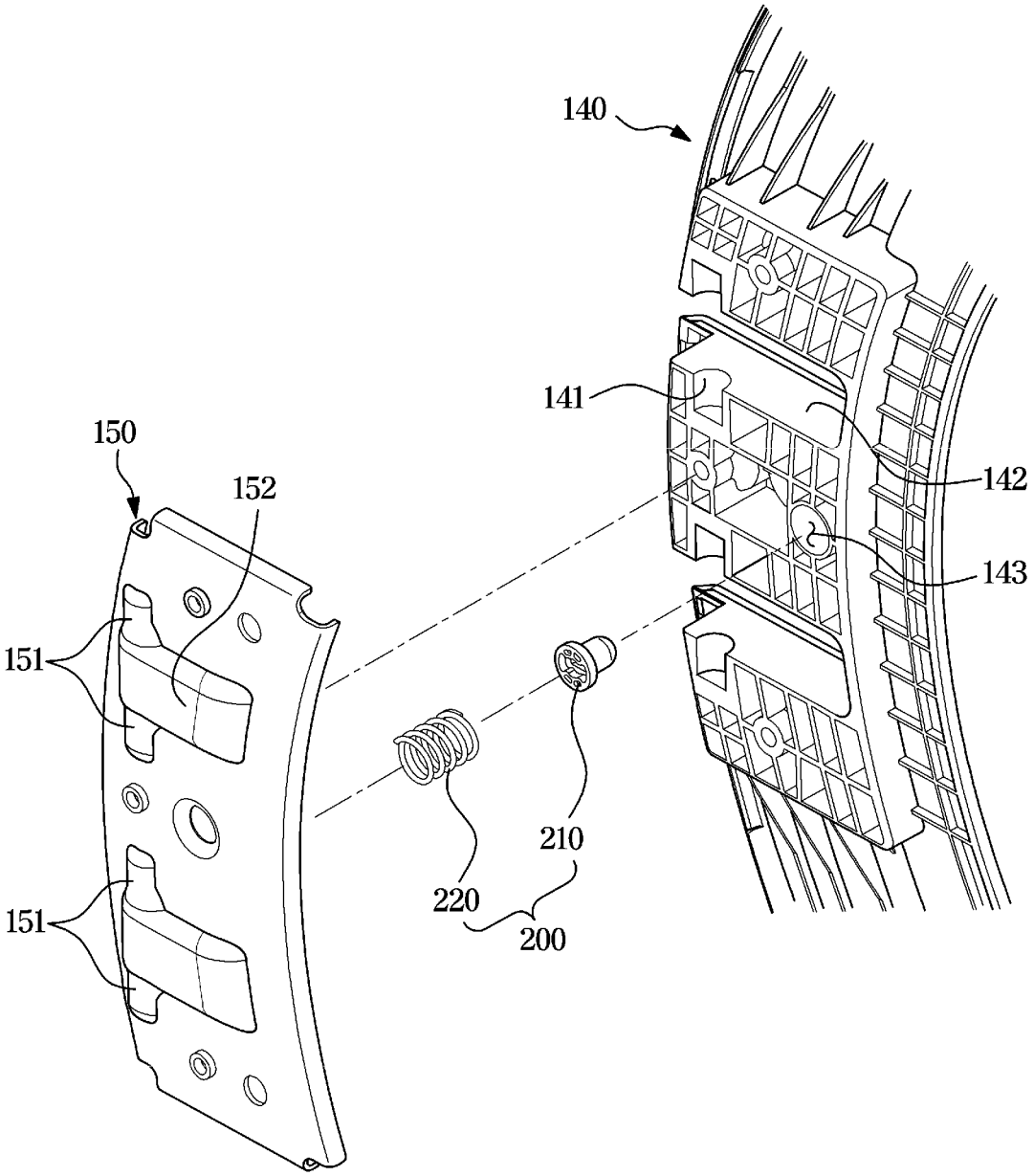
FIG. 7 is a front perspective view illustrating a mounting relationship of the pusher of the washing machine according to an embodiment of the disclosure.

FIG. 5 is an enlarged rear perspective view of a portion of the door and the hinge bracket of the washing machine according to an embodiment of the disclosure, FIG. 6 is a rear perspective view of a pusher and a rear plate of the washing machine according to an embodiment of the disclosure, and FIG. 7 is a front perspective view illustrating a mounting relationship of the pusher of the washing machine according to an embodiment of the disclosure.

Referring to FIGS. 5 and 6, the door 100 may include the pusher 200 and the support plate 150.

The pusher 200 may include the protrusion 210 and the spring 220.

Hereinafter, mounting of the pusher 200 in the door 100 and the configuration of the pusher 200 will be described.

The protrusion 210 of the pusher 200 may protrude to the rear of the door 100 to press a front surface 350 of the hinge bracket 300, Specifically, the protrusion 210 of the pusher 200 may pass through the protrusion passing hole 143 of the rear frame 140.

The protrusion 210 of the pusher 200 may include a pressing part 211 protruding to the rear of the rear frame 140 and to press the hinge bracket 300, and a separation preventing part 212 to prevent the protrusion 210 from being separated from the rear frame 140.

The pressing part 211 may be formed in a substantially cylindrical shape to press the front surface 350 of the hinge bracket 300. The pressing part 211 may extend to the rear of the door 100. That is, the pressing part 211 may extend from the door 100 toward the main body 10.

The separation preventing part 212 may extend radially outward from the pressing part 211. The separation preventing part 212 may be formed in a substantially circular shape. A radius of the separation preventing part 212 may be formed larger than a radius of the protrusion passing hole 143 of the rear frame 140. Through this configuration, the protrusion 210 may be prevented from being separated from the door 100 through the protrusion passing hole 143. Accordingly, a portion of the protrusion 210 of the pusher 200 protrudes to the rear of the rear frame 140 to be exposed to the outside, and the other portion of the protrusion 210 may be accommodated inside the rear frame 140.

The protrusion 210 of the pusher 200 may be formed of a poly-Oxy-methylene (POM) material. The poly-Oxy-methylene (POM) is a material having high strength and wear resistance. However, the material of the protrusion 210 is not limited thereto, and as the pressing part 211 of the protrusion 210 of the pusher 200 directly presses the hinge bracket 300, the material of the pressing part 211 may be formed of a material having a higher strength than that of general plastic to prevent loss of material.

The spring 220 of the pusher 200 may be provided to elastically support the protrusion 210. Specifically, the spring 220 may be wound around the separation preventing part 212 of the protrusion 210 to elastically support forward movement and rearward movement of the protrusion 210. One end of the spring 220 may be supported by the support plate 150. The other end of the spring 220 is wound around the separation preventing part 212 of the protrusion 210. The support plate 150 may be provided in the front of the rear frame 140.

Accordingly, the pusher 200 may be fixed between the rear frame 140 and the support plate 150 disposed in the front of the rear frame 140.

Specifically, a portion fixed between the rear frame 140 and the support plate 150 may be the spring 220 and the separation preventing part 212. The pressing part 211 may protrude to the rear of the rear frame 140. That is, the pusher 200 may be fixed between the rear frame 140 and the support plate 150, and one end of the pusher 200 may protrude to the rear of the door 100.

The pusher 200 is accommodated inside and coupled to the door 100, so that the pusher 200 and the door 100 may be firmly coupled. Through this configuration, the pusher 200 may be prevented from being separated from the door 100 due to an external impact.

Referring to FIGS. 4 to 6, the hinge bracket 300 may be mounted on one side of the door 100.

The hinge bracket 300 may include a body 310 coupled to the front panel 11*a* of the main body 10, and a plurality of legs 320 and shafts 330 extending from the body 310.

The body 310 of the hinge bracket 300 may include the front surface 350 facing the door 100 and a rear surface 360 in contact with the main body 10. A plurality of hooks 340 may be formed on the rear surface 360 of the hinge bracket 300. The hook 340 is inserted into a hook hole (not shown) formed on the front panel 11*a* of the main body 10 so that the hinge bracket 300 and the front panel 11*a* of the main body 10 may be coupled. However, the disclosure is not limited thereto, and the hinge bracket 300 and the main body 10 may be coupled by a separate fastening member.

The plurality of legs 320 may be formed to extend forward from a front surface 350 of the body 310. The plurality of legs 320 may be accommodated in a plurality of leg accommodating portions 142 and 152 formed on the door 100.

Specifically, the plurality of leg accommodating portions 142 and 152 may be formed on the rear frame 140 and the support plate 150. The present embodiment illustrates that the plurality of legs 320 is two, but is not limited thereto. The plurality of leas 320 is provided to support a weight of the door 100. The plurality of legs 320 may be formed in a substantially '¬' shape.

The shaft 330 may be provided to extend from each of the plurality of legs 320 in a rotation axis direction of the door 100. The shaft 330 may be accommodated in a shaft accommodating groove 451, which will be described later. The door 100 may be rotatably coupled to the hinge bracket 300 through the shaft 330.

The rear frame 140 and the support plate 150 of the door 100 may be provided to couple the hinge bracket 300 and the door 100.

Referring to FIGS. 5 to 7, the rear frame 140 and the support plate 150 may form the shaft accommodating groove 451 to accommodate the shaft 330 of the hinge bracket 300.

The rear frame 140 may include a first shaft accommodating portion 141. The first shaft accommodating portion 141 may be provided to accommodate substantially half of the shaft 330 of the hinge bracket 300. The first shaft accommodating portion 141 may be formed by being recessed from the front to a rear inner side of the rear frame 140.

The support plate 150 may include a second shaft accommodating portion 151. The second shaft accommodating portion 151 may be provided to accommodate substantially half of the shaft 330 of the hinge bracket 300, which is the remaining portion that is not accommodated in the rear frame 140. The second shaft accommodating portion 151 may be formed by bending the support plate 150 from the rear to the front.

The first shaft accommodating portion 141 and the second shaft accommodating portion 151 together may form the shaft accommodating groove 451. Accordingly, the shaft 330 of the hinge bracket 300 may be accommodated between the rear frame 140 and the support plate 150 to be rotatable with respect to the hinge bracket 300.

Also, the rear frame 140 and the support plate 150 may form a plurality of leg accommodating grooves 452 to accommodate the plurality of legs 320.

The rear frame 140 may include the first leg accommodating portion 142.

The first leg accommodating portion 142 may be formed by being cut off from one side of the rear frame 140 to accommodate the plurality of legs 320 of the hinge bracket 300. The first leg accommodating portion 142 may be connected to the first shaft accommodating portion 141.

The support plate 150 may include the second leg accommodating portion 152, The second leg accommodating portion 152 may be formed by bending the support plate 150 from the rear to the front so that the plurality of legs 320 of the hinge bracket 300 is accommodated. The second leg accommodating portion 152 may be connected to the second shaft accommodating portion 151 to be bent together.

The first leg accommodating portion 142 and the second leg accommodating portion 152 together may form the plurality of leg accommodating grooves 452. Accordingly, the plurality of legs 320 of the hinge bracket 300 may be accommodated between the rear frame 140 and the support plate 150. Through this configuration, the plurality of legs 320 of the hinge bracket 300 is accommodated inside the door 100 when the door 100 is closed, so that the door 100 may be maintained in a completely closed state.

Referring to FIGS. 5 and 6, the pusher 200 may press the hinge bracket 300.

The pusher 200 may be provided to press the front surface 350 of the body 310 between the plurality of legs 320. The pusher 200 may be accommodated and fixed between the rear frame 140 and the support plate 150, and specifically may be accommodated between the plurality of leg accommodating grooves 452. The protrusion passing hole 143 of the rear frame 140 is formed between the plurality of leg accommodating grooves 452, and the pressing part 211 of the protrusion 210 of the pusher 200 may protrude to the rear of the door 100 between the plurality of leg accommodating grooves 452. That is, the pusher 200 may substantially press a central portion of the front surface 350 of the body 310 of the hinge bracket 300.

As the pusher 200 is formed between the plurality of leg accommodating grooves 452 and presses the central portion of the front surface 350 of the hinge bracket 300 body 310, an open state of the door 100 may be efficiently maintained without applying a large moment. However, the position of the pusher 200 may not be limited thereto.

As the pusher 200 is provided to press only the hinge bracket 300, the open state of the door 100 may be maintained only by the door 100 and the hinge bracket 300, In a case in which the pusher 200 is not provided to press the hinge bracket 300, but, for example, is provided to press the front panel 11*a* of the main body 10, when a design of the washing machine 1 is changed, the design needs to be implemented so that at least, a portion that is to be pressed by the pusher 200 protrudes forward. However, because the pusher 200 of the washing machine 1 according to an embodiment of the disclosure is provided to press the hinge bracket 300, in addition to the designs of the door 100 and the hinge bracket 300, the designs of the main body 10 and the like of the washing machine 1 may be freely implemented.

Hereinafter, a mounting method of the pusher 200 will be described with reference to FIG. 7.

The protrusion 210 of the pusher 200 is inserted into the protrusion passing hole 143 from the front of the rear frame 140. After the spring 220 is mounted in the front of the protrusion 210, the support plate 150 is mounted on the rear frame 140. At this time, the spring 220 is pressed between the support plate 150 and the protrusion 210. The protrusion 210 is pressed between the spring 220 and the rear frame 140.

Accordingly, the pusher 200 may be fixed in a position between the rear frame 140 and the support plate 150, so that the pusher 200 is prevented from being separated.

Because the pusher 200 is coupled in the front of the rear frame 140, that is, inside the door 100, the pusher 200 may be more firmly mounted, Through this configuration, the pusher 200 is not easily separated by an external force.

Figure 8:
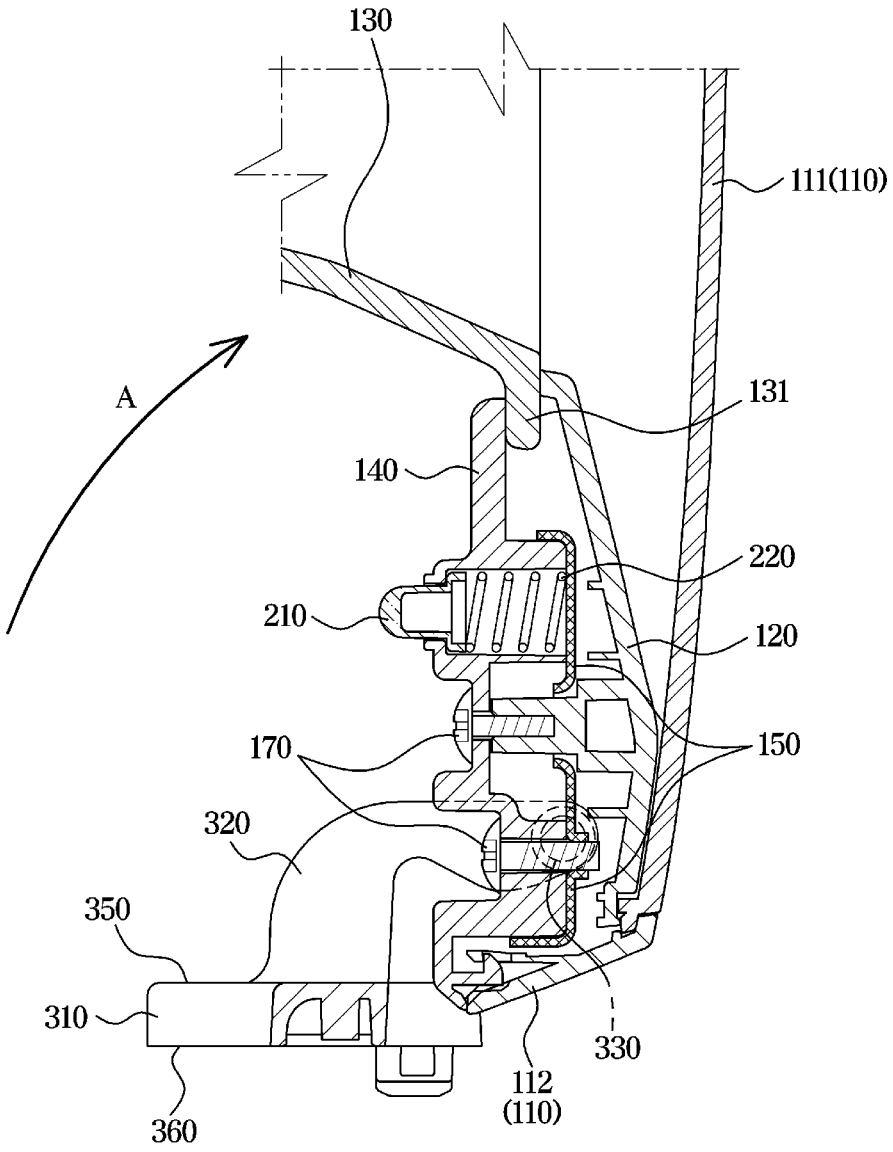
FIG. 8 is a cross-sectional view illustrating a state of the pusher when the door of the washing machine according to an embodiment of the disclosure rotates in a first direction.
Figure 9:
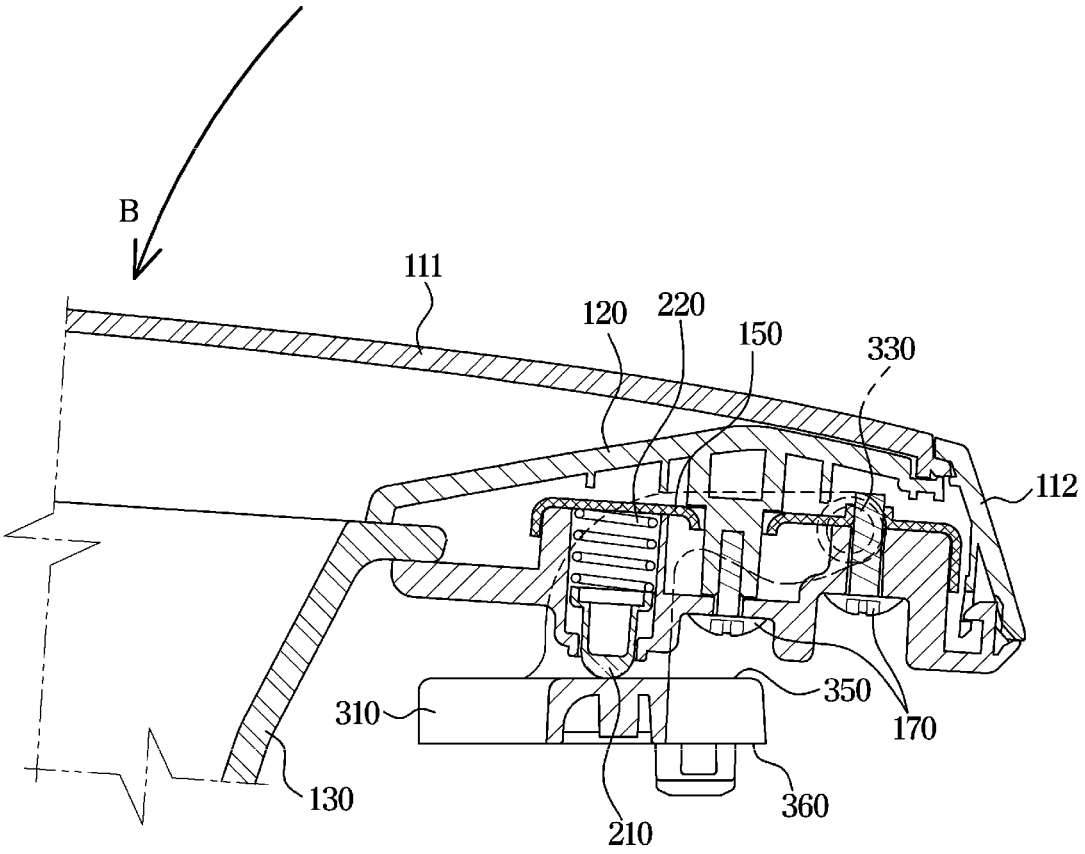
FIG. 9 is a cross-sectional view illustrating a state of the pusher when the door of the washing machine according to an embodiment of the disclosure rotates in a second direction.

FIG. 8 is a cross-sectional view illustrating a state of the pusher when the door of the washing machine according to an embodiment of the disclosure rotates in the first direction A, and FIG. 9 is a cross-sectional view illustrating a state of the pusher when the door of the washing machine according to an embodiment of the disclosure rotates in the second direction B.

As described above, the case where the door 100 rotates in the first direction A refers to a case where the door 100 rotates to an open state. That is, it refers to a case where the door 100 opens the opening 12 and the accommodating space 32. The case where the door 100 rotates in the second direction B refers to a case where the door 100 rotates to a closed state. That is, it refers to a case where the door 100 closes the opening 12 and the accommodating space 32.

Referring to FIGS. 8 and 9, the door 100 may be provided to be rotatable with respect to the hinge bracket 300. The door 100 may include the pusher 200 therein.

The door cover 111 may be provided at the foremost of the door 100. The door cover 111 is provided to form the front surface 350 of the door 100 and the inner frame 120 may be provided in the rear of the door cover 111. The inner frame 120 may support the edge portion 131 of the door glass 130 together with the rear frame 140. Specifically, the edge portion 131 of the door glass 130 may be disposed between the rear frame 140 and the inner frame 120.

The support plate 150 may be disposed between the inner frame 120 and the rear frame 140. The pusher 200 may be accommodated between the support plate 150 and the rear frame 140.

The inner frame 120 and the rear frame 140 may be coupled by the fastening member 170. Specifically, the fastening member 170 may be fastened to the front toward the inner frame 120 from the rear of the rear frame 140. The rear frame 140 and the support plate 150 may also be coupled by the fastening member 170. The fastening member 170 may be fastened to the front toward the support plate 150 from the rear of the rear frame 140. Through this configuration, all components of the door 100 may be easily assembled and coupled.

When the door 100 rotates in the first direction A, the pusher 200 may protrude to the rear of the rear frame 140 while the spring 220 of the pusher 200 is not compressed. Specifically, the pressing part 211 of the protrusion 210 of the pusher 200 may pass through the protrusion passing hole 143 of the rear frame 140. The separation preventing part 212 of the protrusion 210 of the pusher 200 may have a larger diameter than the protrusion passing hole 143 so that the protrusion 210 of the pusher 200 may not be separated from the rear frame 140.

When the door 100 rotates in the second direction B, the pusher 200 may press the front surface 350 of the hinge bracket 300. The pusher 200 may be provided to prevent rotation of the door 100 in the second direction B. In other words, the pusher 200 may be provided to maintain an open state of the accommodating space 32 in the drum 30 by assisting the rotation of the door 100 in the first direction A. At this time, the spring 220 of the pusher 200 may be temporarily compressed by the rotation of the door 100 in the second direction (B), but may be expanded again by an elastic restoring force of the spring 220. When the spring 220 of the pusher 200 is expanded again, the door 100 may be maintained at a predetermined opening angle.

However, when a user rotates the door 100 in the second direction B to lock the closed state of the door 100 so that the lever 160 of the door 100 is coupled to the main body 10, the spring 220 of the pusher 200 is compressed to the maximum so that most of the pusher 200 may be accommodated in the rear frame 140. Therefore, the door 100 may be maintained in a completely closed state while a washing process is in progress.

The pusher 200 may remove moisture from the accommodating space 32 inside the drum 30 by maintaining the door 100 in the open state. Also, the pusher 200 may assist the rotation of the door 100 in the first direction A to allow a user to open the door 100 without applying a strong force.

Through the configuration of the pusher 200, even when an infant accidentally enters the inside of the washing machine 1, a certain level of dissolved oxygen may be secured in the accommodating space 32. The amount of dissolved oxygen may be substantially 18% or more. A description of the opening angle of the door 100 for securing the amount of dissolved oxygen and the stroke length of the pusher 200 will be given later.

Figure 10:
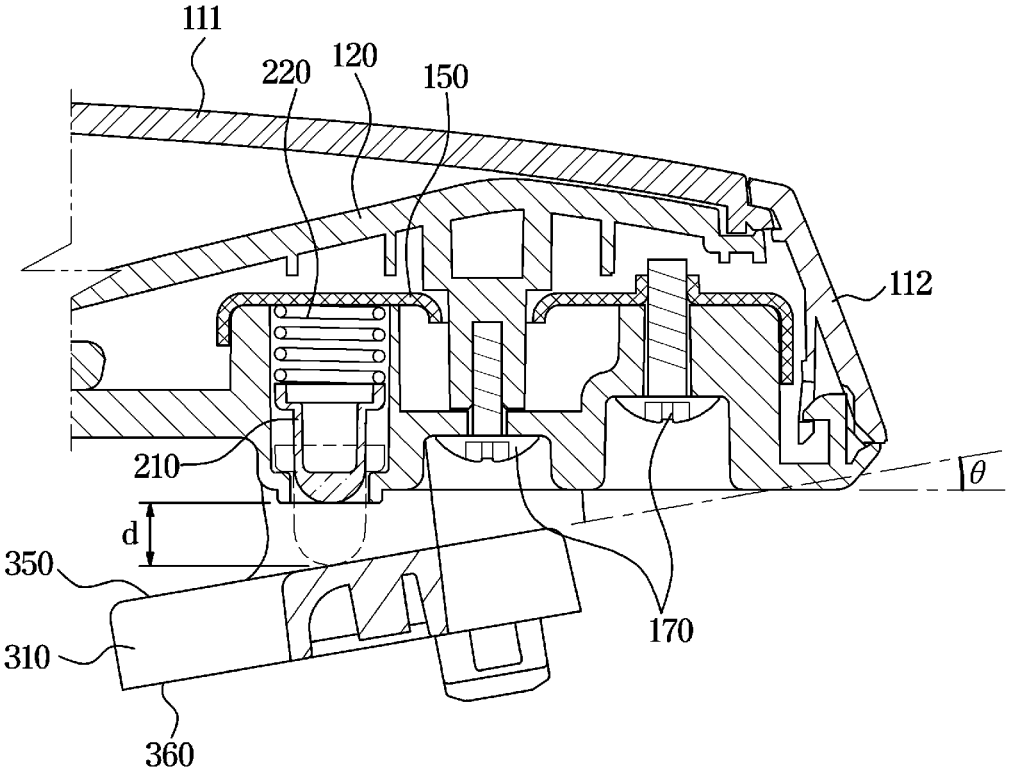
FIG. 10 is a view illustrating a stroke length of the pusher of the washing machine and an opening angle of the door according to an embodiment of the disclosure.

FIG. 10 is a view illustrating a stroke length of the pusher of the washing machine and an opening angle of the door according to an embodiment of the disclosure.

Referring to FIG. 10, the pusher 200 may have a predetermined stroke length d to secure the amount of dissolved oxygen in the accommodating space 32 inside the door 100. Accordingly, the door 100 may secure a predetermined opening angle θ.

The predetermined opening angle θ of the door 100 refers to an angle between the rear surface 360 of the door 100 formed by the rear frame 140 and the front surface 350 of the hinge bracket 300. As long as the door 100 is not closed by the user, the predetermined opening angle θ of the door 100 may be 5 degrees or more. It is appropriate that the predetermined opening angle θ of the door 100 may be substantially 5.5 degrees.

In order to maintain the predetermined opening angle θ of the door 100, the pusher 200 may have the predetermined stroke length d. The stroke length d refers to a length in which the pusher 200 may elastically move forward and backward.

When the door 100 is in the open state, the pusher 200 may maximally protrude to the rear of the door 100 by an elastic force of the spring 220. When the door 100 is in the closed state, the entire pusher 200 may be accommodated inside the rear frame 140 or the door 100. However, the disclosure is not limited thereto, and the pusher 200 may partially protrude to the rear of the door 100 by the spring 220 being compressed when the door 100 is in the closed state. That is, the predetermined stroke length d is a value of a difference between the maximum length and the minimum length of the pusher 200.

As described above, the predetermined opening angle θ of the door 100 may be 5 degrees or more.

It is appropriate that the predetermined stroke length d for securing the predetermined opening angle θ of the door 100 to be substantially 5.5 degrees or more is substantially 3 mm. However, the disclosure is not limited thereto, and the predetermined stroke length d of the pusher 200 may be formed between 2 mm or more and 10 mm or less. The total length of the pusher 200 in which the protrusion 210 of the pusher 200 and the spring 220 are combined may be substantially 13 mm. Accordingly, the pusher 200 may secure the large predetermined opening angle θ with the short predetermined stroke length d. Therefore, a larger amount of dissolved oxygen inside may be ensured.

As the predetermined stroke length d of the pusher 200 and the predetermined opening angle θ of the door 100 are set as described above, the amount of dissolved oxygen in the accommodating space 32 inside the drum 30 may be substantially 18% or more.

However, the disclosure is not limited thereto, and the predetermined opening angle θ of the door 100 may be reset at any time by adjusting the total length and the predetermined stroke length d of the pusher 200, and the longer the predetermined stroke length d, the larger the predetermined opening angle θ of the door 100 may be secured. As the predetermined opening angle θ of the door increases, the amount of dissolved oxygen in the accommodating space 32 inside the drum 30 may increase.

The pusher 200 of the disclosure is formed on one side of the door 100 to press the hinge bracket 300. That is, as the pusher 200 is formed on the hinge bracket 300 side, the large predetermined opening angle θ of the door 100 may be secured even with the short predetermined stroke length d. As the length of the pusher 200 is formed relatively short, the pusher 200 may be prevented from being easily separated by an external impact. In addition, as the pusher 200 is miniaturized, the aesthetics of the rear of the door 100 of the washing machine 1 may be improved.

Further, as the pusher 200 is provided at a position corresponding to the hinge bracket 300 so that the exposure of the pusher 200 is minimized, the overall aesthetics of the washing machine 1 may be improved, and the pusher 200 may be protected from an external impact.

Further, because the pusher 200 of the disclosure is not mounted inside a door by a separate coupling member or fastening member, but is fitted between the rear frame 140 and the support plate 150, a structure of a new form to mount the pusher 200 is not required. Therefore, because a separate additional step is not required in the manufacturing process, the pusher 200 may be easily added to the conventional washing machine 1.

As is apparent from the above, according to the disclosure, because a pusher is formed on a door, moisture in a washing machine can be prevented to maintain a dean state, and the amount of dissolved oxygen in the washing machine can be secured so that personal accidents may be prevented.

According to the disclosure, because the pusher is provided near a rotation axis of the door, a large opening angle of the door can be secured even with a short length of the pusher.

According to the disclosure, because the pusher is provided at a position corresponding to the hinge bracket, the aesthetics of the door can be improved, and the pusher can be protected from an external impact.

According to the disclosure, because the pusher is provided to press only a hinge bracket, designs for shapes of components of the washing machine can be freely implemented.

The foregoing has illustrated and described specific embodiments. However, it should be understood by those of skilled in the art that the disclosure is not limited to the above-described embodiments, and various changes and modifications may be made without departing from the technical idea of the disclosure described in the following claims.

What is claimed is:

1. A washing machine comprising:

a main body;

a drum provided inside the main body and having an accommodating space to accommodate laundry;

a door rotatably provided in a first direction of opening the accommodating space or a second direction of closing the accommodating space; and a hinge bracket coupled to the main body to connect the door and the main body, wherein the door comprises a pusher configured to maintain the accommodating space in an open state by assisting the rotation of the door in the first direction, the pusher pressing the hinge bracket.

2. The washing machine according to claim 1, wherein the pusher comprises a protrusion protruding to the rear of the door to press a front surface of the hinge bracket.

3. The washing machine according to claim 2, wherein the door further comprises a rear frame forming a portion of a rear surface of the door, and a protrusion passing hole through which the protrusion passes is formed on one side of the rear frame.

4. The washing machine according to claim 3, wherein the protrusion comprises a pressing part protruding to the rear of the rear frame, and a separation preventing part extending radially outward so that the protrusion is not separated from the rear frame.

5. The washing machine according to claim 3, wherein the pusher further comprises a spring provided to elastically support the protrusion, and the door further comprises a support plate disposed in the front of the rear frame to support one end of the spring.

6. The washing machine according to claim 1, wherein the hinge bracket comprises:

a body coupled to a front panel of the main body;

a plurality of legs extending from the body; and a shaft extending from each of the plurality of legs in a rotation axis direction of the door.

7. The washing machine according to claim 6, wherein the pusher is provided to press a front surface of the body between the plurality of legs.

8. The washing machine according to claim 6, wherein the door further comprises a rear frame provided to form a portion of a rear surface of the door, and a support plate provided in the front of the rear frame, and the shaft is accommodated between the rear frame and the support plate so that the door rotates with respect to the hinge bracket.

9. The washing machine according to claim 8, wherein the pusher is fixed between the rear frame and the support plate, and one end thereof protrudes to the rear of the door.

10. The washing machine according to claim 8, wherein the rear frame and the support plate form a plurality of leg accommodating grooves to accommodate the plurality of legs.

11. The washing machine according to claim 10, wherein the pusher is provided between the plurality of leg accommodating grooves.

12. The washing machine according to claim 1, wherein the pusher moves elastically, and a stroke length of the pusher is formed between 2 mm or more and 10 mm or less.

13. The washing machine according to claim 12, wherein an opening angle of the door with respect to the main body according to the stroke length of the pusher is formed at 5 degrees or more.

14. The washing machine according to claim 1, wherein the hinge bracket is coupled to the front of the main body to protrude from a front surface of the main body.

15. A washing machine comprising:

a main body having an opening;

a drum provided inside the main body;

a door rotatably provided to open and close the opening; and a hinge bracket coupled to the main body, wherein the door comprises:

a rear frame forming a portion of a rear surface of the door and having one side to which a shaft of the hinge bracket is connected; and a pusher configured to elastically press the hinge bracket by protruding from the rear frame so that the opening is maintained in an open state.

16. The washing machine according to claim 15, wherein the pusher comprises a protrusion provided to press a front surface of the hinge bracket, and a spring provided to elastically support the protrusion.

17. The washing machine according to claim 16, wherein the door further comprises a support plate mounted in the front of one side of the rear frame to support one end of the spring.

18. The washing machine according to claim 17, wherein the protrusion comprises a separation preventing part extending radially outward so that the protrusion is not separated to the rear of the rear frame, and the pusher is fixed and mounted inside the rear frame and the support plate.

19. A washing machine comprising:

a main body having an opening;

a door provided to open and close the opening; and a hinge bracket coupled to the main body so that the door is rotatable with respect to the main body and comprising a shaft accommodated in one side of the door, wherein the door comprises a pusher protruding rearward from one side of the door to elastically press a front surface of the hinge bracket.

20. The washing machine according to claim 19, wherein the door further comprises a rear frame forming a portion of a rear surface of the door, and a support plate forming a shaft accommodating groove together with the rear frame to accommodate the shaft, and the pusher is mounted between the rear frame and the support plate.

* * * * *